United States Patent [19]

Sears

[11] Patent Number: 4,777,849

[45] Date of Patent: Oct. 18, 1988

[54] PACKING EXTRACTOR TOOL

[75] Inventor: Cleo L. Sears, Agra, Kans.

[73] Assignee: Davis, Wright, Unrein, Hummer & McCallister, Topeka, Kans.

[21] Appl. No.: 145,265

[22] Filed: Jan. 19, 1988

[51] Int. Cl.[4] ..... B25B 27/00

[52] U.S. Cl. ..... 81/8.1

[58] Field of Search ..... 81/8.1; 29/239

[56] References Cited

U.S. PATENT DOCUMENTS

| | | | |
|---|---|---|---|
| 118,823 | 9/1971 | Smade | 81/8.1 |
| 1,653,995 | 12/1927 | English | 81/8.1 |
| 1,858,176 | 5/1932 | Webb | 81/8.1 |
| 2,066,598 | 1/1937 | Wiessner | 81/8.1 |
| 2,207,661 | 7/1940 | Dugan | 81/8.1 |
| 3,443,460 | 5/1969 | Johnston, Jr. | 81/8.1 |
| 3,861,248 | 1/1975 | Bushinsky | 81/8.1 |

*Primary Examiner*—Roscoe V. Parker

*Attorney, Agent, or Firm*—Bruce J. Clark

[57] ABSTRACT

A packing extractor tool comprised of an elongated metal shaft and handle attached, whereby the shaft has a flat sharp tip at one end, a first bend which, with the tip, comprises a curved hook; a second bend in the shaft in the same imaginary plane as the curved hook, but in the opposite direction; a third bend in the shaft in the direction perpendicular to the imaginary plane having in it the curved hook. The tool quickly, cleanly, and efficiently removes the packing material in pumps and other equipment.

3 Claims, 3 Drawing Sheets

PACKING EXTRACTOR TOOL

BACKGROUND OF THE INVENTION

This invention relates to that classification of tools utilized for loosening and extracting packing material from stuffing boxes in pumps or other mechanical equipment.

Packing extractor tools are used in maintaining pumps of all sizes (including water plant pumps, industrial pumps, etc). Pumps need to be dismantled periodically, two to three times per year sometimes, in order to repack the rings.

The old ring is usually hard, brittle, worn down, and then existing packing extracting tools often result in a chiseling or chipping of the old ring being removed and results in a piecemeal job. It is difficult therefore to obtain a clean removal of the old ring because small pieces remain in the box. Since it is imperative that the old ring be completely and cleanly removed before packing with a new ring, a considerable amount of time and effort is needed to remove the entire ring.

The prior art does not deal with any of these problems satisfactorily.

Bushinsky, U.S. Pat. No. 3,861,248, discloses a packing extracting tool that comes to a point. It assumes the packing ring will hold together when pierced or poked with the device. In practice the ring crumbles or breaks up and pieces remain stuck to the stuffing box.

Johnston, U.S. Pat. No. 3,443,460, is directed to a helical tool and again discloses a pointed end. It is also utilized by pushing the tool, not pulling.

Dugan, U.S. Pat. No. 2,207,661, is directed to the use of a chain for leverage.

Smade, U.S. Pat. No. 118,823, is directed to a tool utilizing a hook or corkscrew, also lending itself to crumbling and poking the packing ring. Hoffman is similar.

English, Webb and Wiessner (U.S. Pat. Nos. 1,653,995; 1,858,176; 2,066,598 respectively) are all directed to tools that have flexible handles.

It is therefore an object of the invention to provide a packing extractor tool that more easily removes the old ring. It is a further object to remove the ring in as few pieces as possible, even in one piece, without crumbling. It is a further object of the invention to allow the removal of the ring to be completed in a significantly less amount of time while doing so with cleaner results. It is further an object of this invention to allow for easily removing any small packing pieces remaining and to therefore perform the removal in a much quicker, cleaner and easier manner. It is also an object of the invention to attain the previous objectives for most types of packing materials and most types of pumps and machines and to do so at a minimal cost for the tool.

Other objects and features of the invention and objectives and the manner in which the invention achieves its purpose will be appreciated from the following description and the accompanying drawings which exemplify the invention, it being understood that changes may be made in the specific apparatus disclosed herein without departing from the essentials of the invention set forth in the appended claims.

BRIEF SUMMARY OF THE INVENTION

The present invention relates to a packing extractor tool for loosening and extracting packing material, comprised of an elongated metal shaft having a flat sharp tip forming a blade, a first bend in the shaft with the tip included in the bend all comprising a hook portion, in one imaginary plane, a second bend in the shaft in the opposite direction of the first bend in the curved hook, and a third bend in a direction perpendicular to the imaginary plane having in it the curved hook. A handle for holding the shaft is attached.

DESCRIPTION OF THE PREFERRED EMBODIMENTS

Figure 1:
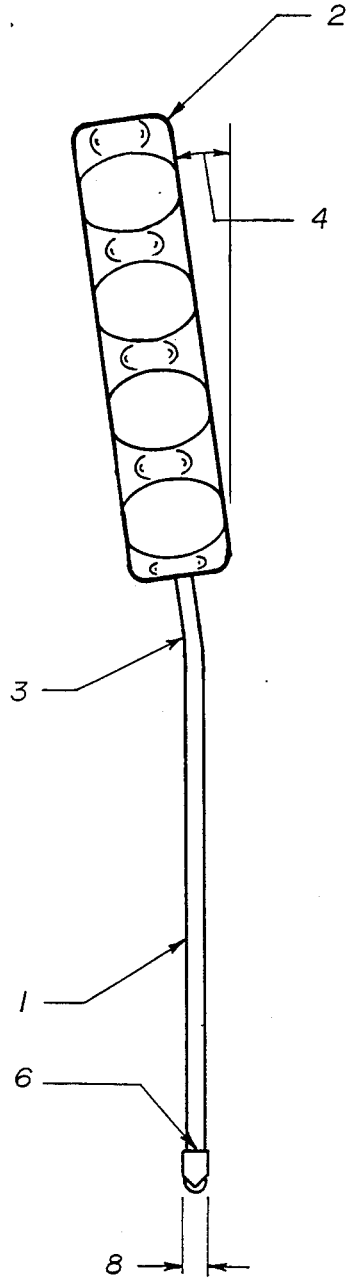
FIG. 1 is a side view of the invention, shown as though looking into the hook portion, with the end of the hook nearest the observer.

Referring to FIG. 1, the preferred embodiment of the invention shown has an elongated metal shaft 1 with a handle 2 for easily gripping the invention.

The shaft has a first bend 3 shown in FIG. 1. The curvature of this bend can vary slightly in form and radius depending on the size of the tool. The angle 4, although also variable, is preferred at approximately seven degrees. The bend 3 allows for the tool to manuever around the shaft of the particular pump and stuffing box from which the packing is being removed. As discussed later, both a righthand tool and a left-hand tool may be needed. The direction of this bend 3 determines whether the tool is a right-hand or left-hand tool. The tool shown in FIG. 1 is a right-hand tool. A left-hand tool would show bend 3 in the opposite direction, i.e. with the handle pointing right rather than left, as shown. This bend 3, as indicated in FIG. 1, is in a direction away from the imaginary plane having in it the curved hook in bend 5, shown in FIGS. 1 and 2.

Figure 2:
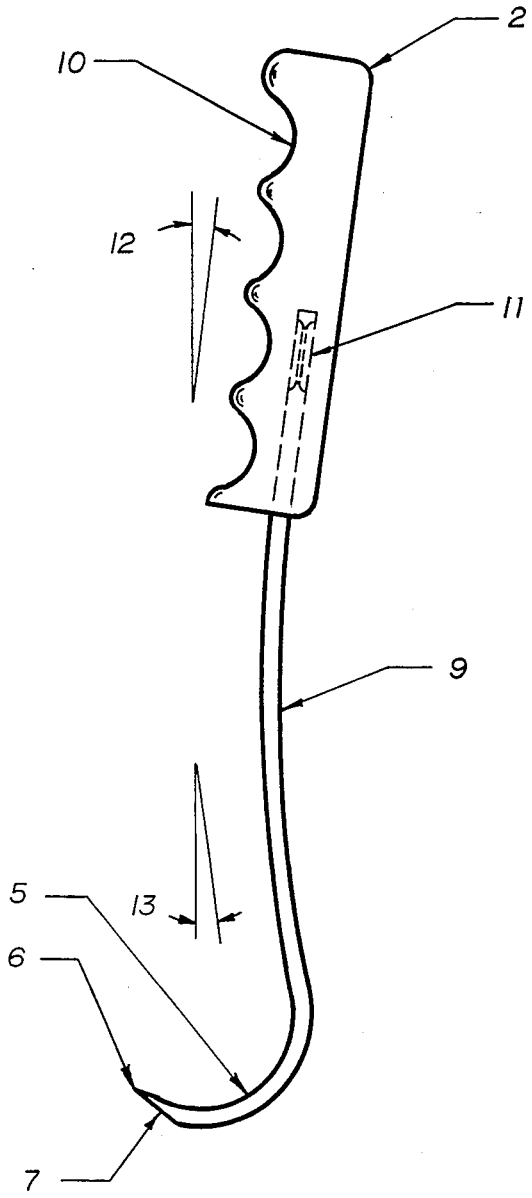
FIG. 2 is a front view of the invention with the hook pointing left.

The curved hook 5, in FIG. 2, is a bend in the shaft having a curvature that is preferably of circular radius, however a noncircular radius would also work. The bend 5 is of a sufficient length and curvature to allow the shaft to comprise the curved hook shape. It is also of sufficient curvature to allow the tip 6 to lie flat under the packing ring.

The tip itself, 6, is formed by a gradual flattening of the shaft 1 near the end of the curved hook bend 5, although other methods of forming a sharp flat tip are envisioned including having a separate attachment to the curved hook bend. The location at which this flattening begins 7 and the distance from that point to the end of the tip varies with the size of the tool, but its preferred relative proportions are as shown in FIG. 2. It is important though that the tip be flattened in this gradual manner to create a sharp blade effect. This allows the tip to slide under the packing and scrape beneath the packing as the tool is pulled around the shaft of the pump, often allowing the ring to be removed in one piece with only a few minor pieces remaining in the stuffing box, far fewer pieces than existing tools or prior art references allow. It also assists to provide a lifting of the packing ring material.

The bend 9 in FIG. 2 is in the opposite direction of the bend in the curved hook 5 and allows the tip to more easily attain the preferred angle to slide under and scrape beneath and lift the packing material while maneuvering around the shaft of the stuffing box. The curvature of this bend 9 can be of any shape, but its relative proportions are as shown in the diagram. Its curvature is preferred to be of circular form, with a large radius relative to the radius of the curved hook bend, slightly more than 10 times the radius of the latter. The curvature, although variable, is preferred such that the end of the shaft at the handle creates an angle 12 of approximately 7 degrees from the original longitudinal axis of the shaft and the curved hook bend portion of the shaft is likewise at an angle 13 of approximately 7 degrees as shown in FIG. 2. These angles are approximate and others may be used.

The handle 2 can be any standard rubber or plastic or other hard or semi-hard material avaialble and is shown in its preferred form with finger displacements 10. The shaft 1 is shown impaled and secured in the handle 2 at 11. Other devices or methods for holding the shaft are envisioned.

The width 8 of the tip 6 shown in FIG. 1 is dependent on the size of the packing ring being removed and should be of a width minutely less than the width of the ring; the preferred value is approximately less 0.020 inch less than the width of the ring. As discussed further herein, a standard set of these tools would consist of various sizes of tips from small to large, depending on the size packing rings used in the various pumps or machines used in the industry. By matching the width 8 of the tip closely to that of the ring being removed, nearly all of the packing material can be lifted and removed at one time, or with very few additional scrapes of the tool. The shape of the tip 6 can be of any form, including a curve; however, a straight edge perpendicular to the imaginary plane including the curved hook is preferred.

Figure 3:
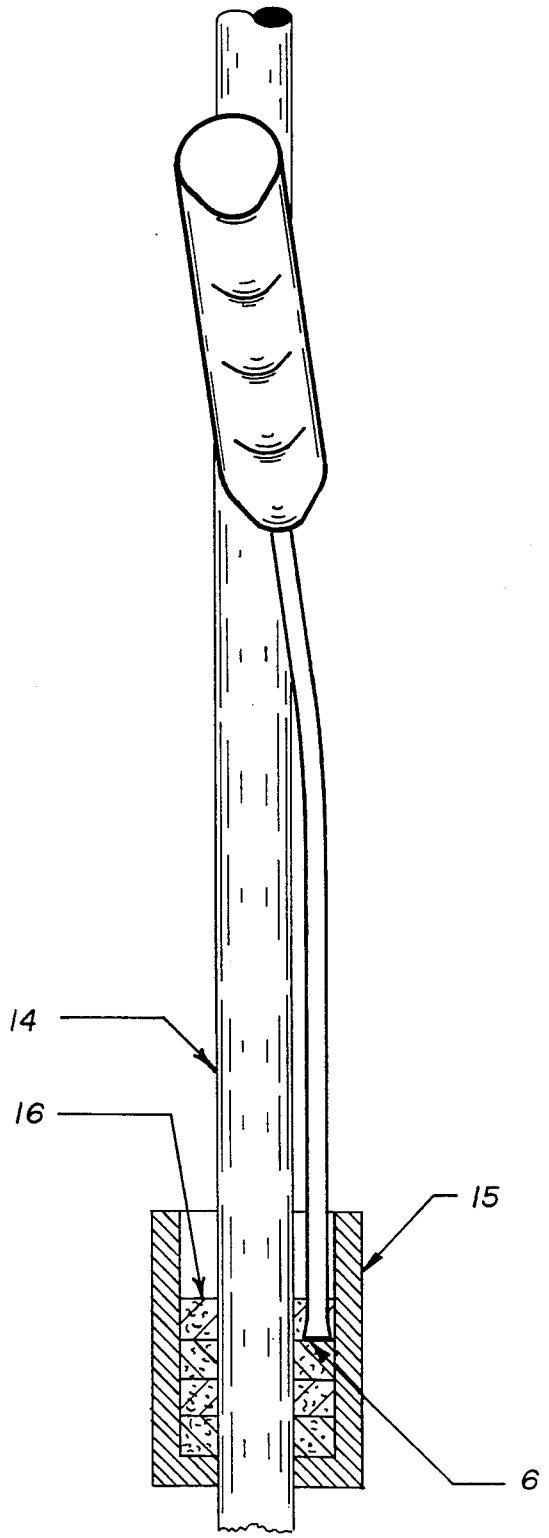
FIG. 3 is a diagram of the tool being used to remove the packing ring in a stuffing box.
Figure 4:
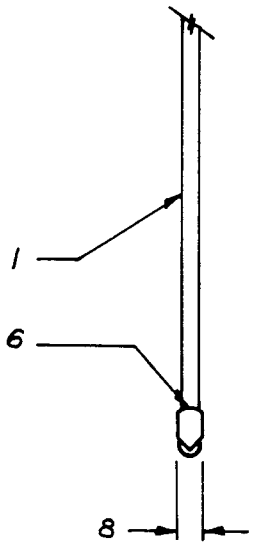
FIG. 4 is a view of the tip shown in FIG. 1, having a curved edge rather than the straight edge shown in FIG. 1.

The shaft 1 is of a length and material such as steel that can bend very slightly in its form to work around the pump shaft 14 in Fig. 3 as the tool is being pulled, yet still maintain the rigidity of the shaft and return to its original shape. Material such as steel meets this requirement provided it is tempered; however, when using the tool on pumps having sleeves 15 made of brass, the material should be slightly detempered at the tip 6 to avoid scarring the brass sleeve. Tools used on pumps with steel sleeves may be tempered throughout including the tip 6. The diameter of the tool shaft 1 should be slightly smaller than the width 8 of the tip 6. Tip sizes vary, but current industry sizes of pumps and packing rings would allow fourteen to twenty tip sizes in the range of from 1/16" to 2Δ.

Sample values for one size of the tool are as follows:

Blade width =0.625 inches

Curved hook 1 and radius 5=0.94 inch

Bend (3) radius =11.50 inch

Bend (9) radius =11.50 inch

Larger or smaller tools would have proportionately larger values or smaller values, respectively.

When working on one pump, either a left-hand or right-hand tool may be required, depending which side of the shaft is easier to get around and also whether the operator is left-handed or right-handed.

The tool is used (either left-hand or right-hand) as shown in FIG. 3., by simply sliding under the packing ring with the tip 6 to engage the tip so that it lies flat under the ring 16, then by pulling the tool around the shaft while pressing, the ring is lifted cleanly and quickly from the stuffing box. Even should the packing ring not be removed in one piece, the tool still removes the majority of the ring, even in pieces, on the first scrape through and does so much more cleanly. Only minor additional scraping may be needed by using the leading edge and corners of the blade. The design of the bends in the tool shaft 1 as shown best facilitate this removal.

The invention can be made as inexpensively or less expensively than existing packing extractor tools, can be used in all known types and materials of packing rings, including teflon, fibrous and graphite materials.

While there have been shown and described particular embodiments of the invention, it will be obvious to those skilled in the art that changes and modifications may be made without departing from the invention or its equivalent, and, therefore, it is intended by the appended claims to cover all such changes and modifications as fall within the true spirit and scope of the invention.

I claim:

1. A packing extractor tool comprised of:

a. An elongated metal shaft comprised of a flat sharp tip at one end comprising a blade; a first bend, said bend and blade comprising a curved hook in an imaginary plane; a second and third bend in the remainder of the shaft, excluding the curved hook, the second bend having a curavture in the direction opposite the direction of the curvature in the curved hook and in the same imaginary plane; the third bend in the direction away from the imaginary plane of the curved hook.

b. Means for gripping the elongated metal shaft, said means connected to the shaft at the end opposite the end having the blade.

2. The packing extractor tool in claim 1 where the leading edge of the blade is a straight edge perpendicular to the imaginary plane of the curved hook.

3. The packing extractor tool in claim 1 where the leading edge of the blade is curved.

* * * * *